US007928659B2

(12) United States Patent
Mun et al.

(10) Patent No.: US 7,928,659 B2
(45) Date of Patent: Apr. 19, 2011

(54) PLASMA DISPLAY APPARATUS

(75) Inventors: Byungjun Mun, Daegu (KR); Chang Hyun Kim, Daegu (KR)

(73) Assignee: LG Electronics Inc., Seoul (KR)

( * ) Notice: Subject to any disclaimer, the term of this patent is extended or adjusted under 35 U.S.C. 154(b) by 1594 days.

(21) Appl. No.: 11/245,258

(22) Filed: Oct. 7, 2005

(65) Prior Publication Data

US 2006/0145620 A1 Jul. 6, 2006

(30) Foreign Application Priority Data

Dec. 17, 2004 (KR) ..... 10-2004-0108303

(51) Int. Cl.
*H01J 17/49* (2006.01)

(52) U.S. Cl. ..... 313/583; 313/582

(58) Field of Classification Search ..... 313/582–587
See application file for complete search history.

(56) References Cited

U.S. PATENT DOCUMENTS

2003/0114606 A1* 6/2003 Taniguchi et al. ..... 525/523

FOREIGN PATENT DOCUMENTS

| | | | |
|---|---|---|---|
| CN | 1215409 | A | 4/1999 |
| EP | 1 157 990 | A2 | 11/2001 |
| EP | 1 391 292 | A1 | 2/2004 |
| EP | 1 486 935 | A1 | 12/2004 |
| KR | 2003-0082741 | A | 10/2003 |
| KR | 2003-0090236 | A | 11/2003 |
| KR | 10-0456153 | B1 | 10/2004 |

* cited by examiner

*Primary Examiner* — Anne M Hines
(74) *Attorney, Agent, or Firm* — Birch, Stewart, Kolasch & Birch, LLP

(57) ABSTRACT

A plasma display apparatus is provided. The plasma display apparatus includes a panel display unit in which a plurality of electrodes are formed, and a panel structure for surrounding at least a portion of the panel display unit. The panel structure includes at least one electrode pad extending from at least one of the electrodes of the panel display unit, at least one connector for applying driving signals to the at least one electrode pad, and a coating layer including a flame-retardant material and coating the at least one electrode pad and the at least one connector.

18 Claims, 5 Drawing Sheets

PLASMA DISPLAY APPARATUS

CROSS-REFERENCES TO RELATED APPLICATIONS

This Nonprovisional application claims priority under 35 U.S.C. §119(a) on Patent Application No. 10-2004-0108303 filed in Korea on Dec. 17, 2004, the entire contents of which are hereby incorporated by reference.

BACKGROUND OF THE INVENTION

1. Field of the Invention

The present invention relates to a plasma display apparatus, and more particularly, to a plasma display apparatus in which the construction of a terminal of the plasma display apparatus is improved, thereby preventing damage to electrodes and securing the flame retardation property.

2. Discussion of the Related Art

Generally, in a plasma display apparatus, a barrier rib formed between a front panel and a rear panel both of which are made of soda-lime glass forms one unit cell. Each cell is filled with a main discharge gas such as neon (Ne), helium (He) or a mixed gas (Ne+He) of Ne and He, and an inert gas containing a small amount of xenon. If the inert gas is discharged with a high frequency voltage, vacuum ultraviolet rays are generated. Phosphors formed between the barrier ribs are light-emitted to display an image.

FIG. 1 is a perspective view illustrating the construction of a plasma display panel (PDP) according to a related art. As shown in FIG. 1, the PDP includes a front panel 10A in which a plurality of sustain electrode pairs having scan electrodes Y and sustain electrodes Z are arranged on front glass 1A serving as the display surface on which the images are displayed, and a rear panel 10B in which a plurality of address electrodes X disposed to cross the plurality of the sustain electrode pairs is arranged on rear glass 1B serving as the rear surface. At this time, the front panel 10A and the rear panel 10B are parallel to each other with a predetermined distance therebetween.

The front panel 10A includes the scan electrodes Y and the sustain electrodes Z, which perform discharge against the other in a mutual manner and maintain emission of cells, in one discharge cell. That is, each of the scan electrodes Y has a transparent electrode 2Y made of a transparent ITO material, and a bus electrode 3Y made of a metal material. Further, each of the sustain electrodes Z has a transparent electrode 2Z made of a transparent ITO material, and a bus electrode 3Z made of a metal material. The scan electrodes Y and the sustain electrodes Z are covered with an upper dielectric layer 4 for limiting a discharge current and providing insulation among the electrode pairs. A protection layer 5 on which magnesium oxide (MgO) is deposited in order to facilitate a discharge condition is formed on the entire surface of the upper dielectric layer 4.

Barrier ribs 7 of a stripe type (or a well type), for forming a plurality of discharge spaces, i.e., discharge cells, are arranged parallel to each other in the rear panel 10B. Further, a plurality of address electrodes X that perform an address discharge to generate vacuum ultraviolet rays are disposed parallel to the barrier ribs 7. R, G and B phosphors 8 that emit visible rays for image display upon address discharge are coated on a top surface of the rear panel 10B. A low dielectric layer 9 for protecting the address electrodes X is formed between the address electrodes X and the phosphors 8.

In the related art PDP constructed above, a frame in which scan, sustain and address driving units are formed, and a terminal for supplying a predetermined signal from each driving unit to the PDP, as the constituent elements of the plasma display apparatus, are formed at the rear surface.

FIG. 2 is a plan view illustrating the construction of a plasma display apparatus according to the related art. FIG. 3 is a partial cross-sectional view of the plasma display apparatus taken along line A-A' in FIG. 2.

Referring to FIGS. 2 and 3, the plasma display apparatus is divided into a panel display unit D1 serving as the PDP, and a panel terminal D2 (area/structure surrounding the display unit D1).

The panel display unit D1 has the same structure as described in FIG. 1. The panel display unit D1 includes a front panel 10A, a rear panel 10B, and a seal material 12 that seals the front panel 10A and the rear panel 10B to form a discharge cell. The front panel 10A includes transparent electrodes 2Y, 2Z (2) constituting scan electrodes or sustain electrodes that are formed on front glass 1A in a parallel way, metal bus electrodes 3Y, 3Z (3) formed at the edges on the transparent electrodes 2Y, 2Z (2), a metal bus electrode pad 11 that extends from the metal bus electrodes 3Y, 3Z (3) up to the panel terminal D2, and an upper dielectric layer 4 and a protection film 5 that are sequentially formed on the front glass 1A to cover the transparent electrodes 2, the metal bus electrode 3 and the metal bus electrode pad 11. The rear panel 10B includes address electrodes X formed on the rear glass 1B to cross the scan electrodes or the sustain electrodes, and a lower dielectric layer laminated on a rear glass to cover the address electrodes X.

The panel terminal D2 includes the metal bus electrode pad 11 that is formed on the front glass 1A to extend from the panel display unit D1, and a film type element 14 that is connected to the metal bus electrode pad 11 and applies a driving signal controlled in a printed circuit board (PCB). At this time, the metal bus electrode pad 11 and the film type element 14 are adhered using an anisotropic conductive film (hereinafter, referred to as "ACF") 16. The ACF 16 has a film form in which metal-coated epoxy or conductive particles such as metal particles are dispersed. It serves to electrically connect the metal bus electrode 3 and the film type element 14.

In the panel terminal D2 in which the film type element 14 and the metal bus electrode pad 11 are adhered using the anisotropic conductive film 16, the metal bus electrode pad 11 made of silver (Ag) is exposed to external air. Thus, when a PDP is driven, there is a problem in that the electrodes are damaged due to reaction with external environment, such as temperature, moisture, corrosive gas and/or conductive alien substance, i.e., migration.

This migration phenomenon can be expressed into the following Chemical Formulae (1) to (5).

$$Ag^{+}+e^{-}\rightarrow Ag \quad (1)$$

$$O_2+2H_2O+4e^{-}\rightarrow 4OH^{-} \quad (2)$$

$$2H_2O+2e^{-}\rightarrow 4OH^{-} \quad (3)$$

$$Ag\rightarrow Ag^{+}+e^{-} \quad (4)$$

$$H_2O\rightarrow \tfrac{1}{2}O_2+2H^{+}+2e^{-} \quad (5)$$

First, if neighboring two electrodes (e.g., between Y and Z electrodes) include silver (Ag) and a voltage difference is generated between the pads 11 of these two electrodes, the pads 11 of the neighboring two electrodes become the cathode and the anode, respectively. Thus, a positive ion ($Ag^{+}$) of silver is eluted in the anode, as in Chemical Formula (4), and then moves to the cathode under dissolved oxygen. Accordingly, the reduction reaction is generated in the cathode, as in Formula (1), and silver is thus precipitated on the cathode. Chemical Formulae (2) and (3) indicate the rate-deciding step of deciding the generation rate of migration, Chemical Formula (2) indicates the reduction reaction of dissolved oxygen, and Chemical Formula (3) indicates electrolysis and hydrogen creation reaction.

If an application voltage rises and a voltage difference between the pads 11 of the two electrodes becomes high, the current is increased and the generation of migration is accelerated that much. In other words, if the application voltage rises, the current of the cathode is increased due to Chemical Formulae (2) and (3) being the initial reaction of the cathode, so that elution reaction current of silver in the anode increases. That is, if electrolysis occurs between the pads 11 of the two neighboring electrodes, as in Chemical Formula (5), and oxygen is generated accordingly, Ag+ of silver existing in the anode moves to the cathode, and the reaction such as Chemical Formulae (2) and (3) is thus generated on a surface of the cathode. Ag+ is combined with OH−, and is then dispersed in collide form of AgOH, Ag, $Ag_2O$ compound on the surface of the cathode. Consequently, if a voltage difference occurs between the pads 11 of the two electrodes, surface discoloration is generated and open electrodes are generated in each of the neighboring two pads 11 or shortage is generated between the two pads 11.

As such, in order to prevent electrode discoloration and electrode short due to the reaction of moisture, in the related art, ultraviolet hardening resin being epoxy acrylate based resin having a high hardening strength and good wetproof property is coated on the panel terminal D2.

Further, there is a problem of abnormal discharge and erroneous discharge, wherein a cell where a discharge cell must be turned on is turned off or a cell where a discharge cell must be turned off is turned on because of heat generated due to the load of various causes, such as voltage load or switching load of a switching element, when a PDP is driven. Further, if the load becomes high and much heat is generated, fire can be generated in the panel terminal including the film type element in which much heat is generated, among the constituent elements of the PDP. Accordingly, this creates a problem in that the function of the PDP is fully lost and the PDP can be rendered inoperative.

This problem, i.e., the problem of lowered picture quality such as erroneous discharge and abnormal discharge due to the generation of heat can be improved by controlling a voltage applied to the panel in the conventional circuit unit or a voltage waveform. As far as the heat actually generated when the PDP is driven, however, there is no alternate heatproof means except for radiation of heat using a heatproof plate attached to the rear side of the PDP or a heat sink formed on a driving circuit substrate. Thus, if a heat radiation characteristic is not good, there is a problem in that the above-described display terminal loses its function of the PDP since it is vulnerable to fire and malfunction.

SUMMARY OF THE INVENTION

Accordingly, the present invention has been made in view of the above and other problems occurring in the related art, and it is an object of the present invention to provide a plasma display apparatus in which damage to electrodes can be prevented or minimized by securing a flame retardation property in which the plasma display apparatus is rarely burnt by fire caused by heat of a panel terminal, and by securing a wetproof property.

It is another object of the present invention to provide a plasma display panel structure and a plasma display apparatus and method, which overcome the limitations and disadvantages associated with the related art.

To achieve the above and other objects, according to an aspect of the present invention, there is provided a plasma display apparatus, including a panel display unit in which a plurality of electrodes is formed, and a panel terminal for applying a driving signal to the electrodes. The panel terminal includes an electrode pad extending from the electrodes of the panel display unit, an element electrically connected to the electrode pad, for applying the driving signals, and a resin layer including a flame-retardant material covering the electrode pad and connectors of the element.

According to an aspect of the present invention, the electrodes of the panel display unit may be any one of scan electrodes, sustain electrodes and data electrodes. The flame-retardant material may include at least one of a halogen-based material, aluminum (Al)-based resin, phosphor (P)-based resin, and melamine-based resin. The resin layer may include ultraviolet-hardening resin, and the ultraviolet-hardening resin may include either oligomer or monomer. The flame-retardant material can be preferably used in the amount of 20 wt % to 50 wt % based on the total weight of the coating layer including the flame-retardant material. The ultraviolet-hardening resin can be preferably used in the amount of 60 wt % to 80 wt % based on the total weight of the coating layer including the flame-retardant material. The ultraviolet-hardening resin can preferably have a viscosity of 2000 cps to 30000 cps.

According to another aspect of the present invention, there is provided a panel structure for surrounding at least a portion of a panel display unit of a plasma display apparatus, the panel display unit including a plurality of electrodes, the panel structure comprising: at least one electrode pad extending from at least one of the electrodes of the panel display unit; at least one connector for applying driving signals to the at least one electrode pad; and a coating layer including flame-retardant material and coating the at least one electrode pad and the at least one connector.

According to another aspect of the present invention, there is provided a plasma display apparatus including a panel display unit in which a plurality of electrodes are formed, and a panel structure for surrounding at least a portion of the panel display unit, wherein the panel structure comprises: at least one electrode pad extending from at least one of the electrodes of the panel display unit; at least one connector for applying driving signals to the at least one electrode pad; and a coating layer including a flame-retardant material and coating the at least one electrode pad and the at least one connector.

According to another aspect of the present invention, there is provided a panel structure for surrounding at least a portion of a panel display unit of a plasma display apparatus, the panel display unit including a plurality of electrodes, the panel structure comprising: at least one electrode pad extending from at least one of the electrodes of the panel display unit; at lest one connector for applying driving signals to the at least one electrode pad; and a coating layer including a flame-retardant material and coating the at least one electrode pad and the at least one connector, wherein the flame-retardant material includes at most two of the following: a halogen-based material, an aluminum (Al)-based resin, a phosphor (P) based resin, and a melamine-based resin.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Further objects and advantages of the invention can be more fully understood from the following detailed description taken in conjunction with the accompanying drawings in which.

DETAILED DESCRIPTION OF THE PREFERRED EMBODIMENTS

The present invention will now be described in detail in connection with preferred embodiments with reference to the accompanying drawings.

Figure 1:
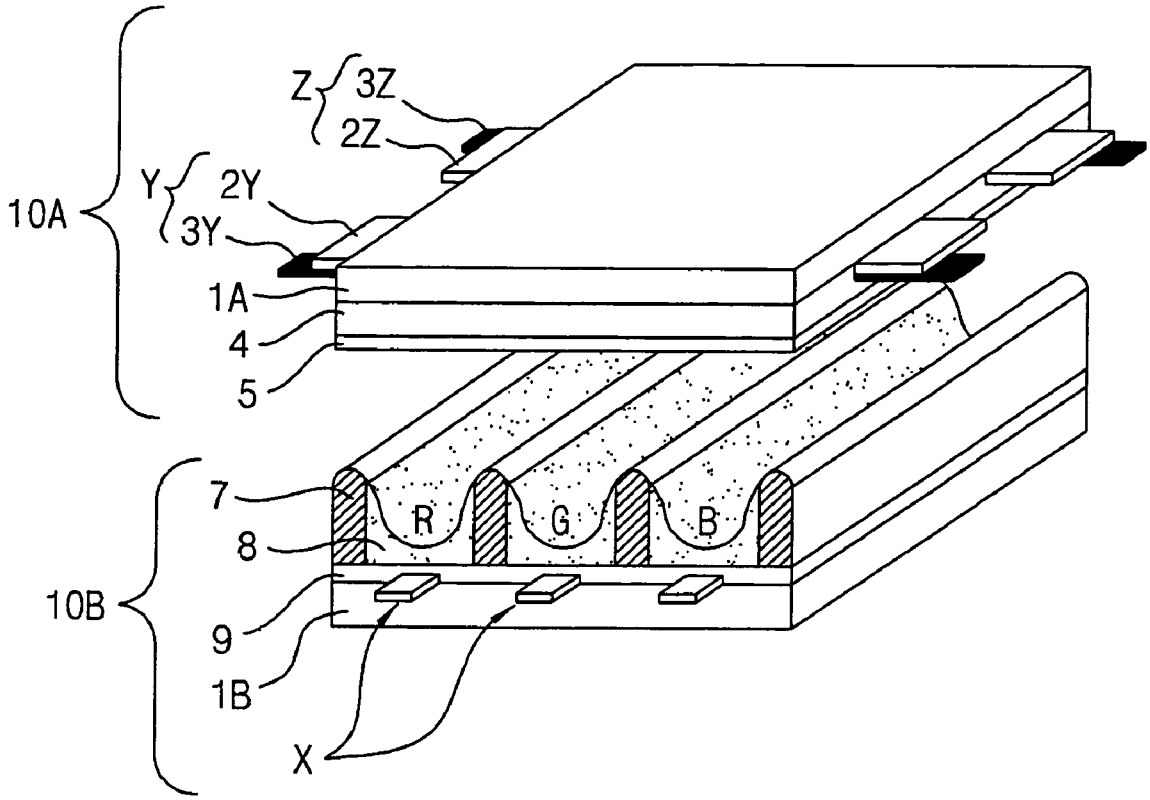
Fig. 1 RELATED ART
FIG. 1 is a perspective view illustrating the construction of a PDP according to a related art.
Figure 2:
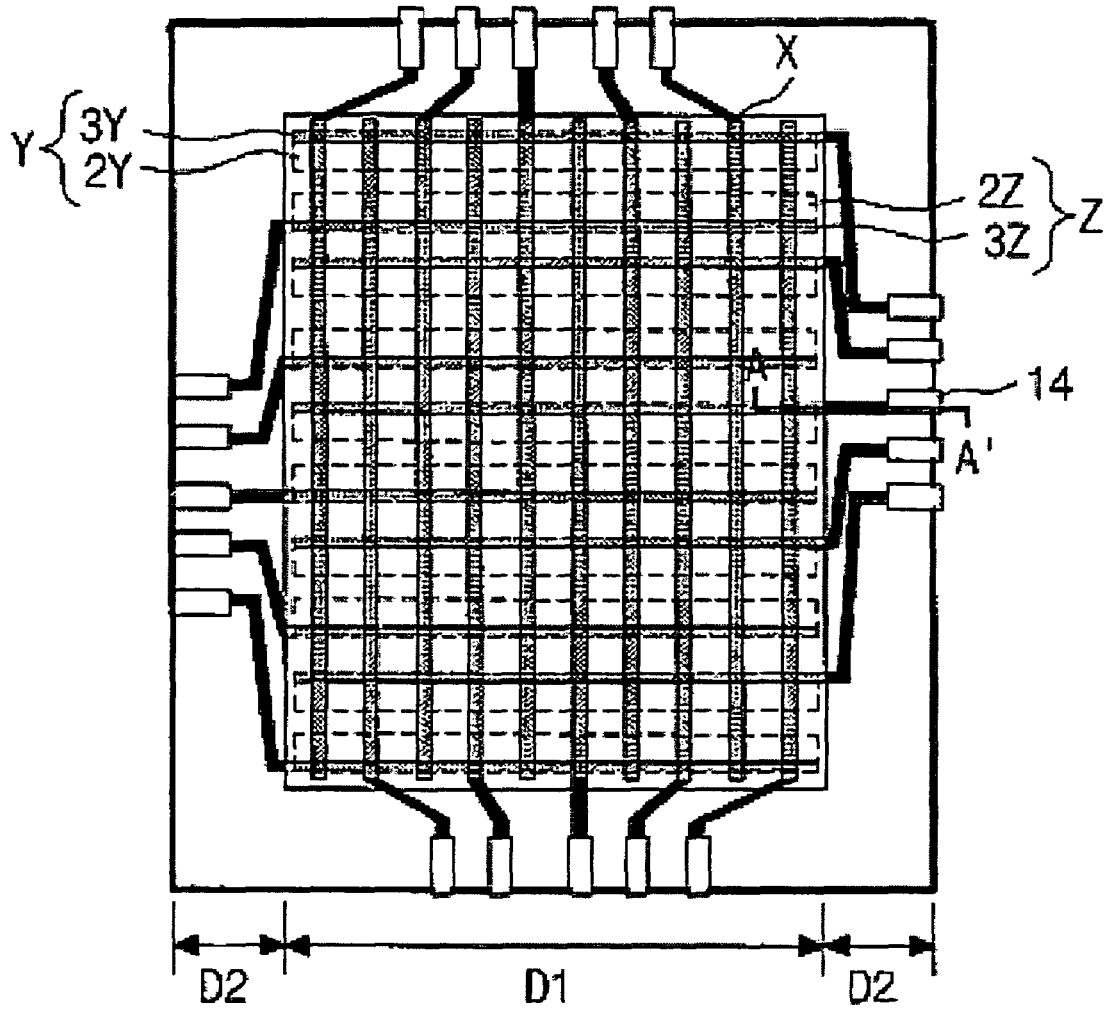
Fig. 2 RELATED ART
FIG. 2 is a plan view of the construction of a plasma display apparatus according to the related art.
Figure 3:
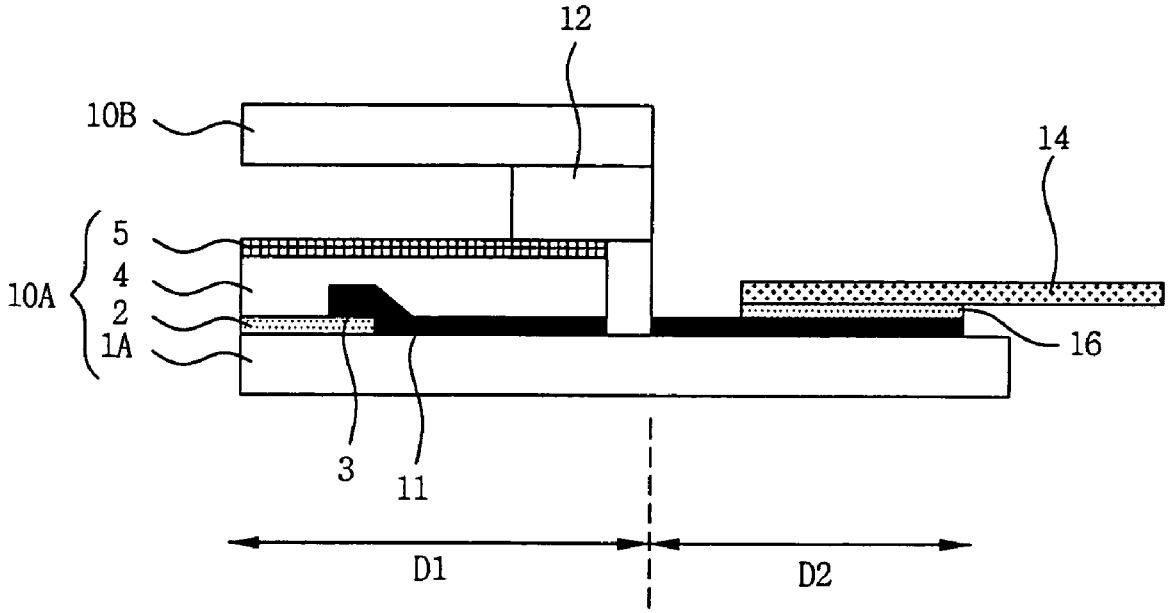
Fig. 3 RELATED ART
FIG. 3 is a partial cross-sectional view of the plasma display apparatus taken along line A-A' of FIG. 2.
Figure 4:
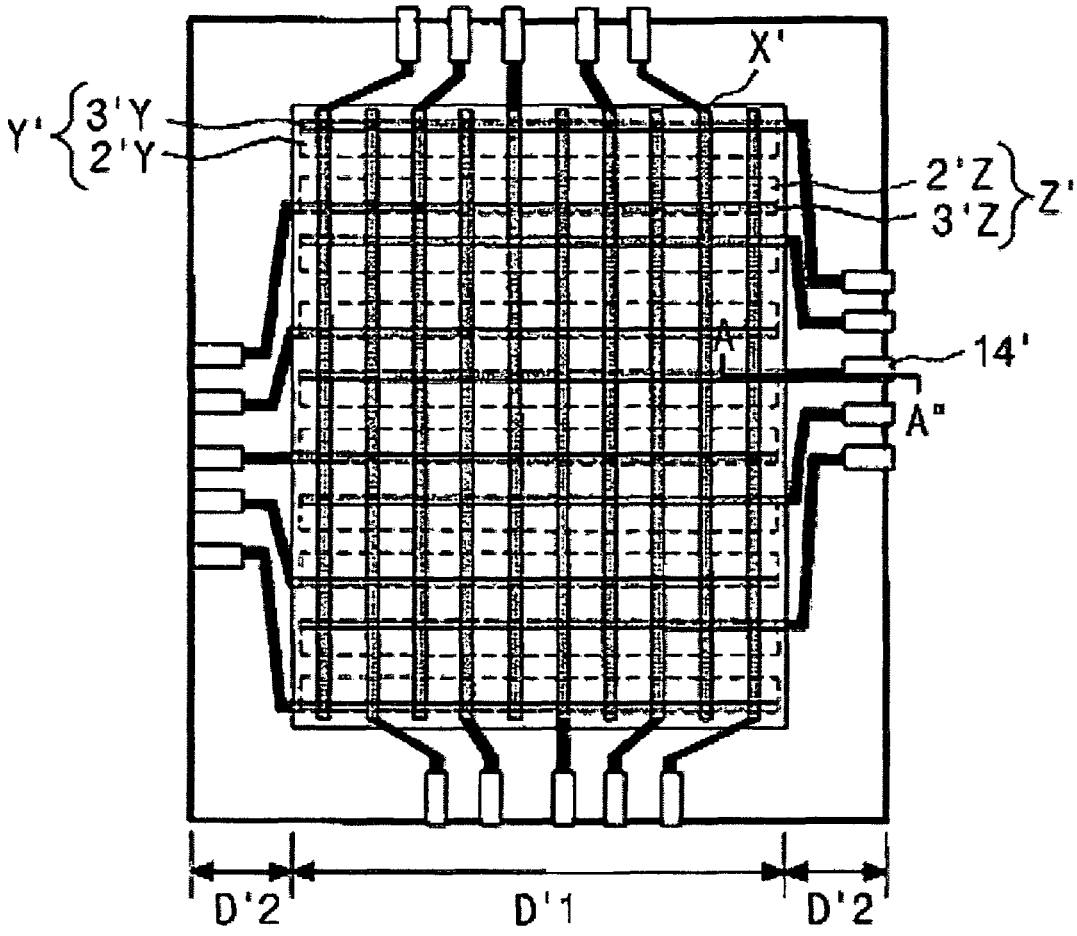
FIG. 4 is a plan view of a plasma display apparatus according to the present invention.
Figure 5:
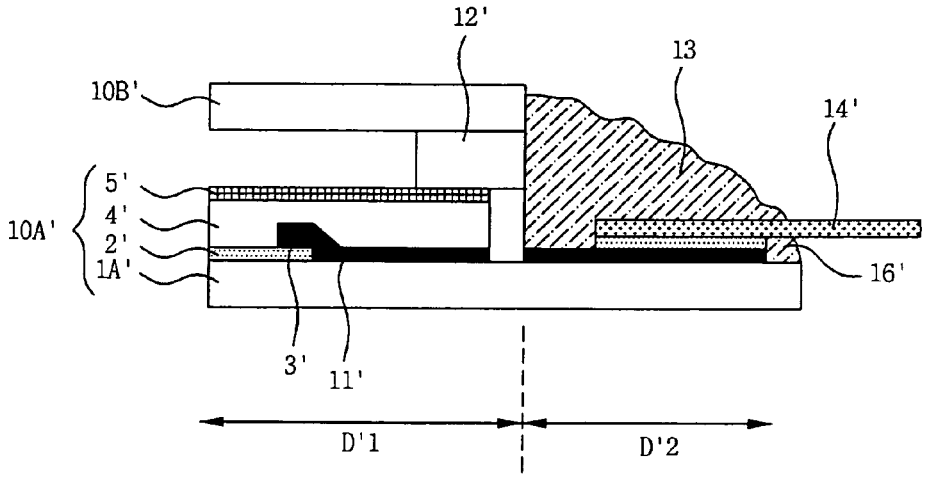
FIG. 5 is a partial cross-sectional view of the plasma display apparatus taken along line A-A" of FIG. 4 according to the present invention.

FIG. 4 is a plan view of a plasma display apparatus according to an embodiment of the present invention. FIG. 5 is a partial cross-sectional view of the plasma display apparatus taken along line A-A" in FIG. 4 according to the present invention.

Referring to FIGS. 4 and 5, the plasma display apparatus according to the present invention includes a PDP in which a plurality of electrodes is formed, i.e., a panel display unit D'1 on which images are displayed, and panel terminals D'2 for supplying driving signals to the electrodes within the panel display unit D'1. The panel terminals D'2 completely surround the panel display unit D'1 in this example. However, the panel terminal(s) D'2 may surround only a portion of the panel display unit D'1. All the components of the plasma display apparatus are operatively coupled.

The panel display unit D'1 includes a front panel 10'A, a rear panel 10'B, and a seal material 12' that seals the front panel 10'A and the rear panel 10'B to form a discharge cell, in the same manner as the related art. The front panel 10'A includes transparent electrodes 2'Y, 2'Z (2') constituting scan electrodes Y' or sustain electrodes Z' formed on front glass 1'A in a parallel way, metal bus electrodes 3'Y, 3'Z (3') formed at the edges on the transparent electrodes 2'Y, 2'Z (2'), a metal bus electrode pad 11' that extends from the metal bus electrodes 3'Y, 3'Z (3') up to the panel terminals D'2, and an upper dielectric layer 4' and a protection film 5' that are sequentially laminated on the front glass 1'A in such a way to cover the transparent electrodes 2', the metal bus electrode 3' and the metal bus electrode pad 11'.

The rear panel 10'B includes address electrodes X formed on rear glass to cross the scan electrodes Y' or the sustain electrodes Z', and a lower dielectric layer laminated on the rear glass to cover the address electrodes X.

Each panel terminal D'2 on each side of the apparatus includes an electrode pad 11' (e.g., a metal bus electrode pad) that extends from the panel display unit D'1 on the front glass 1'A, an element 14' that is connected to the corresponding electrode pad 11' and applies a driving signal controlled in a PCB, and a film type element such as a chip on flexible printed circuit (COF) or a tape carrier package (TCP). At this time, the electrode pad 11' and the film type element 14' are adhered using an ACF 16'. The ACF 16' has a film form in which metal-coated epoxy or conductive particles such as metal particles are dispersed, and (electrically connects the corresponding electrode pad 11' electrically connected to the metal bus electrode 3') and the corresponding film type element 14'.

Further, the panel terminals D'2 of the plasma display apparatus according to the present invention are coated with resin 13 so that the electrode pad 11' extending from the panel display unit D'1 can secure prevention of electrode shortage, which is incurred by reaction with external environment such as temperature, moisture, corrosive gas or conductive alien substance, and can secure a flame retardation property. More particularly, connectors of the electrode pad 11' and the film type element 14' are coated with the resin 13 containing a flame-retardant material, which forms a layer. This layer is referred to as the resin layer 13. At this time, this flame-retardant material includes at least one of a halogen-based material such as bromine (Br), an aluminum (Al) based resin, a phosphor (P) based resin and a melamine based resin (i.e., one or more of these resins). The resin layer 13 also includes an ultraviolet-hardening resin. The ultraviolet-hardening resin here can include either oligomer or monomer.

Figure 6:
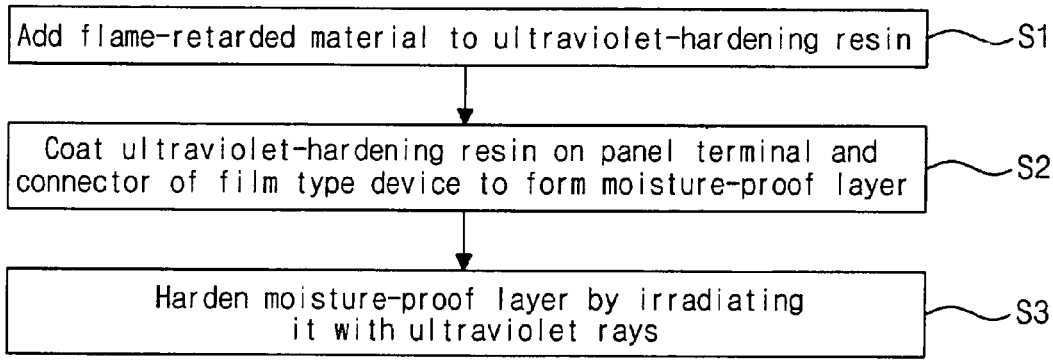
FIG. 6 is a flowchart illustrating a method of forming a resin layer including a flame-retardant material of the plasma display apparatus according to the present invention.

FIG. 6 is a flowchart illustrating a method of forming a resin layer containing a flame-retardant material of the plasma display apparatus according to an embodiment of the present invention. This method can be applied to form the resin layer 13.

Referring to FIG. 6, in the method of forming the resin layer containing the flame-retardant material according to the present invention, at least one of a halogen-based material such as bromine (Br), an aluminum (Al) based resin, a phosphor (P) based resin and a melamine based resin, which are flame-retardant materials, is first added to an ultraviolet-hardening resin [S1]. At this time, the content of the flame-retardant material is set to 20 wt % to 50 wt % based on the total weight of the resin layer including the flame-retardant material. Furthermore, the content of the ultraviolet-hardening resin is set to 60 wt % to 80 wt % based on the total weight of the resin layer including the flame-retardant material.

As such, the weight ratios of the flame-retardant material and the ultraviolet-hardening resin to the coating layer according to the present invention can be differently set. This is aimed at differently setting the weight percentage according to a viscosity condition of the ultraviolet-hardening resin. However, there may be a problem in that the connectors of the electrode pad 11' and the film type element 14' are not sufficiently covered because dispersion is not good or fluidity becomes low as the viscosity increases. Accordingly, the ultraviolet-hardening resin is set to have predetermined viscosity, and has a viscosity of 2000 cps to 30000 cps.

The ultraviolet-hardening resin including the flame-retardant material formed thus is coated on the panel terminal to form the resin layer such as the resin layer 13 in FIG. 5 [S2]. This is for allowing the metal electrodes of the electrode pad to secure prevention of electrodes shortage due to reaction with external environment, such as temperature, moisture, corrosive gas or conductive alien substance, and to secure a flame retardation property. More particularly, the flame-retardant ultraviolet-hardening resin is coated on the electrode pad of the panel terminal and the connectors of the film type element, securing the moisture-proof and flame retardation functions. At this time, the electrode included in the electrode pad can be the metal electrode of the scan electrode, the metal electrode of the sustain electrode, or the data electrode.

Thereafter, the resin layer (13) formed in the panel terminal is fully hardened by irradiating it with ultraviolet rays [S3]. Accordingly, the present invention provides the resin layer which exhibits both a flame-retardation property and a moisture-proof property.

As described above, the present invention is advantageous in that damage to electrodes formed in a panel terminal of a plasma display apparatus, which can be incurred by external environment, can be prevented, a flame retardation property can be secured, and reliability of the plasma display apparatus can be improved accordingly.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A panel structure for surrounding at least a portion of a panel display unit of a plasma display apparatus, the panel display unit including a plurality of electrodes, the panel structure comprising:

at least one electrode pad extending from at least one of the electrodes of the panel display unit;

at least one connector configured to apply driving signals to the at least one electrode pad; and a coating layer including a flame-retardant material and coating the at least one electrode pad and the at least one connector, wherein the flame-retardant material includes at least one of a halogen-based material, an aluminum (Al)-based resin, and a melamine-based resin.

2. The panel structure as claimed in claim 1, wherein an amount of the flame-retardant material present in the coating layer is 20 wt % to 50 wt % of a total weight of the coating layer.

3. The panel structure as claimed in claim 1, wherein the coating layer further includes an ultraviolet-hardening resin.

4. The panel structure as claimed in claim 3, wherein an amount of the ultraviolet-hardening resin present in the coating layer is 60 wt % to 80 wt % of a total weight of the coating layer.

5. The panel structure as claimed in claim 3, wherein the ultraviolet-hardening resin includes either oligomer or monomer.

6. The panel structure as claimed in claim 3, wherein the ultraviolet-hardening resin has a viscosity in the range of 2000 cps to 30000 cps.

7. The panel structure as claimed in claim 1, wherein the at least one of the electrodes of the panel display unit includes at least one scan electrode, at least one sustain electrode, and/or at least one data electrode.

8. The panel structure as claimed in claim 1, further comprising:

at least one conductive adhesive layer between the at least one electrode pad and the at least one connector.

9. A plasma display apparatus including a panel display unit in which a plurality of electrodes are formed, and a panel structure for surrounding at least a portion of the panel display unit, wherein the panel structure comprises:

at least one electrode pad extending from at least one of the electrodes of the panel display unit;

at least one connector configured to apply driving signals to the at least one electrode pad; and a coating layer including a flame-retardant material and coating the at least one electrode pad and the at least one connector, wherein the flame-retardant material includes at least one of a halogen-based material, an aluminum (Al)-based resin, and a melamine-based resin.

10. The plasma display apparatus as claimed in claim 9, wherein an amount of the flame-retardant material present in the coating layer is 20 wt % to 50 wt % of a total weight of the coating layer.

11. The plasma display apparatus as claimed in claim 9, wherein the coating layer further includes an ultraviolet-hardening resin.

12. The plasma display apparatus as claimed in claim 11, wherein an amount of the ultraviolet-hardening resin present in the coating layer is 60 wt % to 80 wt % of a total weight of the coating layer.

13. The plasma display apparatus as claimed in claim 11, wherein the ultraviolet-hardening resin includes either oligomer or monomer.

14. The plasma display apparatus as claimed in claim 11, wherein the ultraviolet-hardening resin has a viscosity in the range of 2000 cps to 30000 cps.

15. The plasma display apparatus as claimed in claim 9, wherein the at least one of the electrodes of the panel display unit includes at least one scan electrode, at least one sustain electrode, and/or at least one data electrode.

16. The plasma display apparatus as claimed in claim 9, further comprising:

at least one conductive adhesive layer between the at least one electrode pad and the at least one connector.

17. A panel structure for surrounding a panel display unit of a plasma display apparatus, the panel display unit including a plurality of electrodes, the panel structure comprising:

at least one electrode pad extending from at least one of the electrodes of the panel display unit;

at least one connector configured to apply driving signals to the at least one electrode pad; and a coating layer including a flame-retardant material and coating the at least one electrode pad and the at least one connector, wherein the flame-retardant material includes at most two of the following: a halogen-based material, an aluminum (Al)-based resin, and a melamine-based resin.

18. The panel structure as claimed in claim 17, wherein an amount of the flame-retardant material present in the coating layer is 20 wt % to 50 wt % of a total weight of the coating layer.

* * * * *